US008636383B2

(12) United States Patent
Riley et al.

(10) Patent No.: US 8,636,383 B2
(45) Date of Patent: Jan. 28, 2014

(54) LASER SIGNALING BUOY AND METHOD OF USING

(75) Inventors: Louis F. Riley, Weston, FL (US); Juan Carlos Casas, Coral Gables (ES)

(73) Assignee: Juan Carlos Casas, Coral Gables, FL (US)

( * ) Notice: Subject to any disclaimer, the term of this patent is extended or adjusted under 35 U.S.C. 154(b) by 0 days.

(21) Appl. No.: 13/370,437

(22) Filed: Feb. 10, 2012

(65) Prior Publication Data

US 2012/0206908 A1 Aug. 16, 2012

Related U.S. Application Data

(60) Provisional application No. 61/441,329, filed on Feb. 10, 2011.

(51) Int. Cl.

| | |
|---|---|
| ***F21L 4/00*** | (2006.01) |
| ***B63B 45/00*** | (2006.01) |
| ***B63B 22/20*** | (2006.01) |

(52) U.S. Cl.
USPC ..... 362/259; 362/183; 362/477

(58) Field of Classification Search
USPC ..... 362/183, 470, 259, 477; 441/13, 16, 17; 340/985
See application file for complete search history.

(56) References Cited

U.S. PATENT DOCUMENTS

| | | | | | |
|---|---|---|---|---|---|
| 4,796,167 | A * | 1/1989 | Brown et al. | ..... | 362/158 |
| 5,066,256 | A * | 11/1991 | Ward, Sr. | ..... | 441/7 |
| 5,448,235 | A * | 9/1995 | O'Neill et al. | ..... | 340/985 |
| 5,748,080 | A * | 5/1998 | Clay | ..... | 340/539.26 |
| 6,126,299 | A * | 10/2000 | Hypes et al. | ..... | 362/259 |
| 6,280,049 | B1 * | 8/2001 | Tam | ..... | 362/158 |
| 7,088,222 | B1 | 8/2006 | Dueker et al. | | |
| 7,125,298 | B1 * | 10/2006 | Frank | ..... | 441/11 |
| 7,311,000 | B2 | 12/2007 | Smith et al. | | |
| 7,320,631 | B1 * | 1/2008 | Distefano et al. | ..... | 441/16 |
| 8,337,040 | B1 * | 12/2012 | Easley | ..... | 362/192 |
| 2002/0155767 | A1 * | 10/2002 | Sung | ..... | 441/16 |
| 2011/0104967 | A1 * | 5/2011 | Jeffrey | ..... | 441/17 |

* cited by examiner

*Primary Examiner* — Peggy A. Neils
(74) *Attorney, Agent, or Firm* — Hartman Global IP Law; Gary M. Hartman; Domenica N. S. Hartman

(57) ABSTRACT

A signaling buoy and method suitable for emitting a light signal over long distances in marine environments. The buoy includes a watertight enclosure having a compartment, an aperture at an upper end of the enclosure for emitting a laser light beam therethrough, a laser light source disposed within the enclosure for generating the light beam, and a battery within the enclosure for powering the light source. Electrical contacts are disposed on an exterior of the enclosure and are adapted to complete an electrical circuit when an electrical short exists therebetween to conduct electrical power from the battery to the laser light source. The buoy is configured to float upright in water with the electrical contacts submersed in the water.

20 Claims, 2 Drawing Sheets

LASER SIGNALING BUOY AND METHOD OF USING

CROSS REFERENCE TO RELATED APPLICATIONS

This application claims the benefit of U.S. Provisional Application No. 61/441,329, filed Feb. 10, 2011, the contents of which are incorporated herein by reference.

BACKGROUND OF THE INVENTION

Current marine signaling products include devices that use traditional lighting means, for example, LEDs, incandescent bulbs, and strobe flash lamps. These traditional means all utilize incoherent lighting technology that produce light that dissipates with distance. As such, these products prove to be less effective with increasing distance between the signal and an intended observer. In the case where the signal is intended to be a distress signal, this limitation of current marine signaling products can delay and even prevent the signal being observed by a potential rescuer.

BRIEF DESCRIPTION OF THE INVENTION

The present invention provides a signaling buoy and method suitable for emitting a light signal over long distances in marine environments.

According to a first aspect of the invention, the signaling buoy includes a watertight enclosure comprising a compartment having lower and upper ends, an aperture in the upper end of the enclosure adapted for emitting a laser light beam therethrough, a laser light source disposed within the enclosure and adapted to generate the laser light beam, and a battery within the enclosure for powering the laser light source. At least two electrical contacts are disposed on an exterior of the enclosure and are adapted to complete an electrical circuit when an electrical short exists therebetween to conduct electrical power from the battery to the laser light source. The buoy further comprises ballast that is sufficient to cause the buoy to float upright in water with the first end of the enclosure and the electrical contacts submersed in the water and with the second end of the enclosure disposed above the water.

Another aspect of the invention is a method of using the buoy comprising the elements described above to generate a distress signal by placing the buoy in water so that at least two of the electrical contacts are submersed in the water to cause an electrical short therebetween and conduct electrical power from the battery to the laser light source.

According to yet another aspect of the invention, a method of producing a distress signal is provided that includes placing a signaling buoy in water so that a lower end thereof is submersed in the water and the water creates an electrical short between at least two electrical contacts to cause electrical power to be conducted to a laser light source within the signaling buoy. As a result, a laser light beam is generated with the laser light source and is emitted through an upper end of the signaling buoy that is not submersed in the water.

A technical effect of the invention is the ability of the signaling buoy to emit a coherent laser light source that offers increased beam intensity over greater distances as compared to traditional incoherent signaling devices. The buoy may emit a single collimated beam, multiple collimated beams, and/or beams of various shapes, for example, lines, to increase the likelihood of the beam(s) being spotted from great distances. Furthermore, because the signaling buoy is adapted to be automatically activated when contacted by water, the buoy can be quickly put in service without any special steps taken by the user.

Other aspects and advantages of this invention will be better appreciated from the following detailed description.

DETAILED DESCRIPTION OF THE INVENTION

Figure 1:
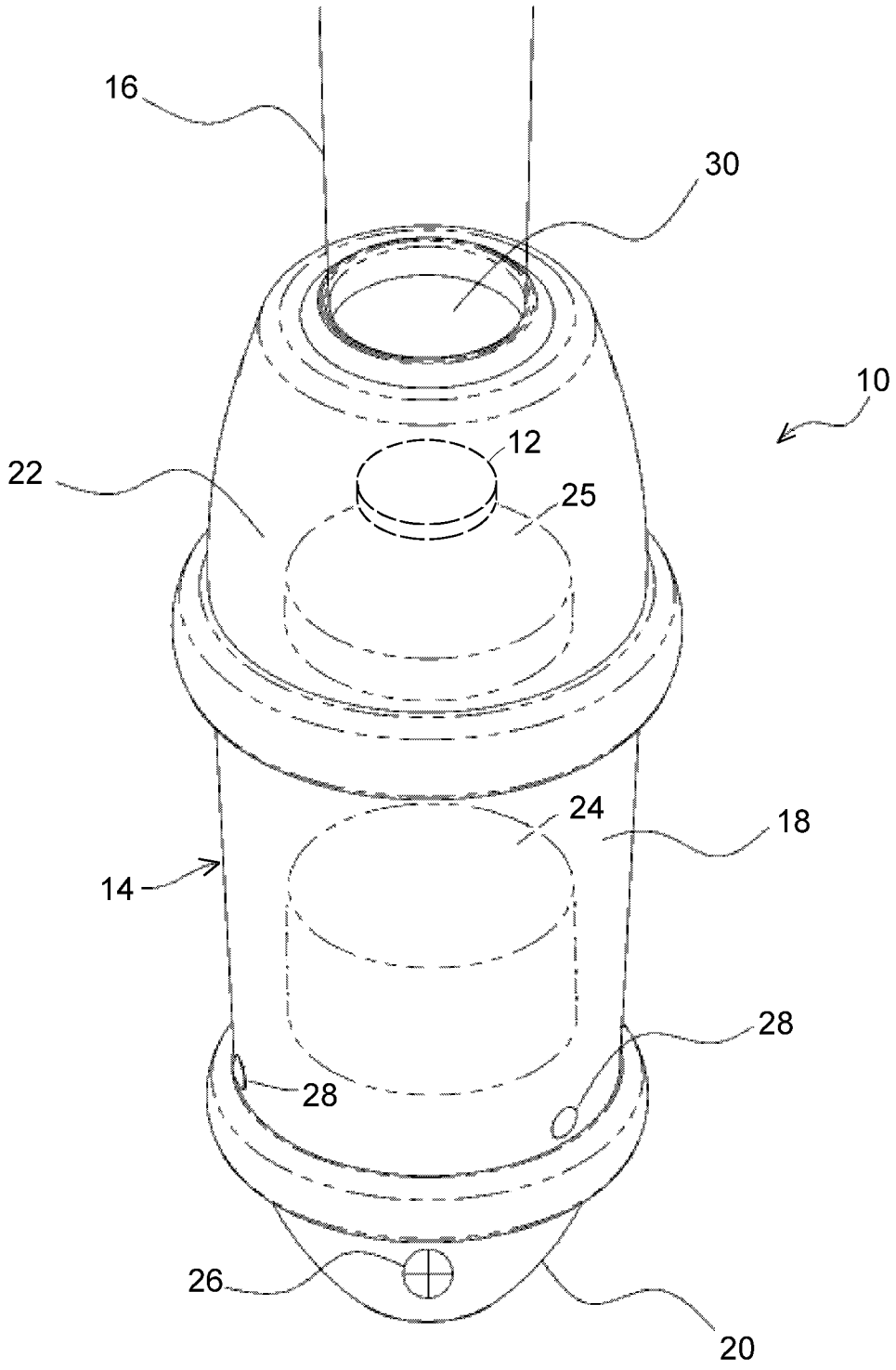
FIG. 1 is a perspective view of a laser signaling buoy in accordance with an embodiment of the present invention.
Figure 2:
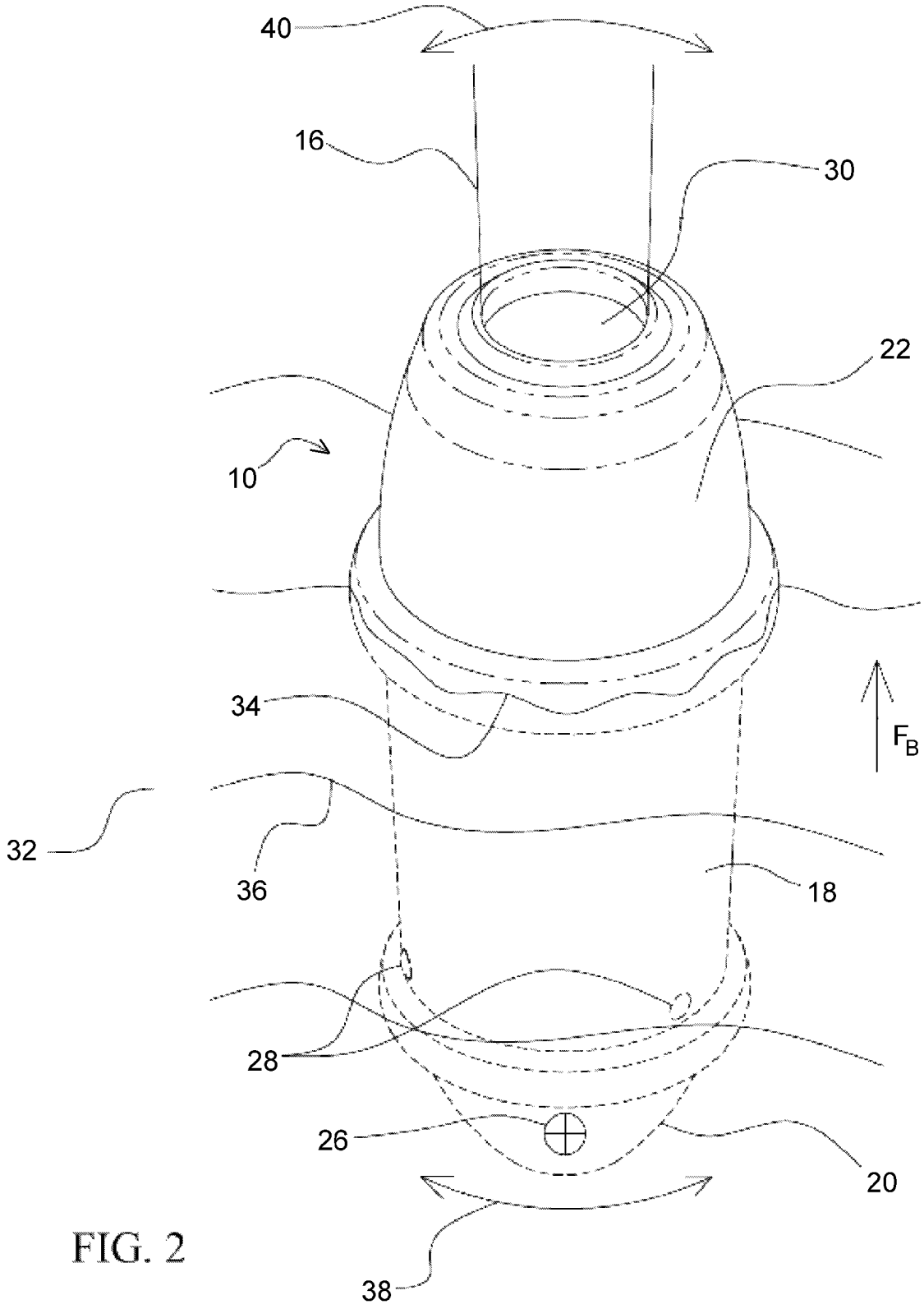
FIG. 2 is a perspective view of the signaling buoy of FIG. 1 operating within a marine environment.

FIGS. 1 and 2 schematically represent a laser signaling buoy 10 comprises a coherent laser light source 12 packaged in a buoyant, self-righting and watertight enclosure 14 so as to be suitable for use as an aid in distress situations, including but not limited to marine environments. The light source 12 of the signaling buoy 10 generates at least one laser beam 16, whose coherent nature allows for greater intensity over much farther distances as compared to LEDs, incandescent bulbs, strobe flash lamps and other more traditional incoherent lighting technologies. As a result, when used as a distress signal, the laser beam 16 generated by the signaling buoy 10 is capable of significantly increasing the likelihood that search and rescue teams will be able to locate a distressed party in the vicinity of the buoy 10.

Referring to FIG. 1, the watertight enclosure 14 of the signaling buoy 10 includes a main compartment 18, a lower cap 20 that closes a lower end of the compartment 18, and an upper cap 22 that closes the oppositely-disposed upper end of the compartment 18. The caps 20 and 22 may be attached to the compartment 18 with threads or in any other manner capable of providing a watertight seal. Alternatively, one of the caps 20 or 22 may be permanently affixed to the compartment 18. The compartment 18 is preferably configured to house a battery 24 for powering the laser light source 12, and for this reason at least one of the caps 20 and 22 is preferably removable to provide access to the battery 24. The upper cap 22 preferably defines an electronics bay adapted to contain the laser light source 12 as well as electronics (not shown) for controlling the operation of the light source 12.

The laser light source 12 can be of any suitable type known in the art and can be adapted to generate one or more laser beams (16) of any suitable eye-safe wavelength. Furthermore, the light source 12 can be configured to emit continuous wave (CW) beams or pulsed beams 16, the latter of which allows the light source 12 to be programmed to broadcast Morse code, for example, an SOS signal. A pulsing operation of the light source 12 has the additional advantage of extending the life of the battery 24. Alternatively or in addition, the laser signaling buoy 10 can incorporate a simple mechanical generator 25 to supplement or recharge the battery power. As an example, the buoy 10 may be equipped with a copper coil and magnet of a known design to generate an electrical current when the buoy 10 is subjected to movement, for example, physical shaking or the natural wave motion to which the buoy 10 is subjected when floating in a large body of water. The electrical current can be used to create an electrical charge that can be stored in a capacitor until sufficient electrical energy is stored to supplement or charge the battery 24.

The interior of the lower cap 20 is lined with or otherwise contains a ballast formed of a relatively dense material, for example, brass, steel, or lead, to provide the buoy 10 with a low center of gravity 26 in relation to an emission aperture 30 located in the upper cap 22 through which the laser light beam 16 is emitted from the buoy 10. In particular, the ballast causes the buoy 10 to remain upright when floating in water, with the lower cap 20 immersed. The ballast is sufficient to ensure that at least two of the electrical contacts 28, represented as being exteriorly located at a lower extremity of the compartment 18, will be submersed when the buoy 10 is floating in water, as represented in FIG. 2. While the contacts 28 are represented as being located on the exterior of the compartment 18, it is foreseeable that the contacts 28 could be located on the lower cap 20.

According to a preferred aspect of the invention, contacting two or more contacts 28 with water creates an electrical short across the contacts 28, completing an electrical circuit (not shown) that includes the laser light source 12 and battery 24, such that the light source 12 is powered by the battery 24 to generate its laser beam(s) 16 through the aperture 30 in the upper cap 22. As such, by simply placing the buoy 10 in water, the ballast associated with the lower cap 20 causes the buoy 10 to right itself as well as submerses the contacts 26, thereby completing the electrical circuit that includes the laser light source 12 and battery 24 so that the laser beam 16 is generated and emitted from the aperture 30. Notably, in combination with the buoyance provided by the watertight enclosure 14, the ballast is not sufficient to cause the upper cap 22 of the buoy 10 and its aperture 30 to also become submersed.

FIG. 2 depicts the laser signaling buoy 10 submersed in water 32. The buoy's low center of gravity 26 induced by the weighted lower cap 20 counteracts the natural buoyant force, $F_B$, of the buoy 10 that results from at least the main compartment 18 of the buoy 10 defining an airtight chamber. As such, the buoy 10 is upright and partially submerged so that the water line 34 is always below the emission aperture 30 but above the electrical contacts 28 to insure continuous activation of the light source 12 and continuous generation of the laser beam 16 while the buoy 10 remains submersed as depicted in FIG. 2. Natural motion of waves 36 will induce a rocking motion 38 of the weighted lower cap 20, which in turn causes a rocking motion 40 of the upper cap 22 and the aperture 30. This rocking motion 40 causes a random motion of the laser beam 16, with the likelihood of increasing the chance that the beam 16 will be spotted and the buoy 10 located. As previously noted, the motion induced in the buoy 10 by the waves 36 can also be utilized to generate electrical energy that can be stored and subsequently used to extend the life of the battery 24.

While the invention has been described in terms of a specific embodiment, it is apparent that other forms could be adopted by one skilled in the art. For example, the physical configuration of the buoy 10 could differ from that shown, and materials and processes other than those noted could be used. Furthermore, the buoy 10 could be further equipped with a mechanical switch (not shown) for activating the light source 12, for example, if there is a need or desire to make use of the buoy 10 outside of a marine environment. Therefore, the scope of the invention is to be limited only by the following claims.

The invention claimed is:

1. A signaling buoy comprising:

a watertight enclosure comprising a compartment having lower and upper ends;

an aperture in the upper end of the enclosure and adapted for emitting a laser light beam therethrough;

a laser light source disposed within the enclosure and adapted to generate the laser light beam;

a battery within the enclosure for powering the laser light source;

at least two electrical contacts disposed on an exterior of the enclosure and adapted to complete an electrical circuit when an electrical short exists therebetween to conduct electrical power from the battery to the laser light source; and a ballast associated with the lower end of the enclosure, the ballast being sufficient to cause the buoy to float upright in water with the first end of the enclosure and the electrical contacts submersed in the water and with the second end of the enclosure disposed above the water.

2. The signaling buoy according to claim 1, further comprising a first cap closing the lower end of the compartment and a second cap closing the upper end of the compartment.

3. The signaling buoy according to claim 2, wherein the ballast is on or within the first cap.

4. The signaling buoy according to claim 3, wherein the ballast locates a center of gravity of the buoy within the first cap.

5. The signaling buoy according to claim 3, wherein the ballast locates a center of gravity of the buoy below the electrical contacts.

6. The signaling buoy according to claim 2, wherein the second cap defines an electronics bay that contains the laser light source.

7. The signaling buoy according to claim 1, wherein the laser light source is adapted to emit a continuous wave beam.

8. The signaling buoy according to claim 1, wherein the laser light source is adapted to emit pulsed beams.

9. The signaling buoy according to claim 1, further comprising a mechanical generator adapted to supplement and/or recharge the battery.

10. The signaling buoy according to claim 9, wherein the mechanical generator is adapted to generate electrical power in response to the signaling buoy being subjected to movement.

11. A method of using the signaling buoy of claim 1 to produce a distress signal, the method comprising placing the signaling buoy in water so that the ballast associated with the lower end of the enclosure causes the signaling buoy to right itself and submerse at least two of the electrical contacts in the water to cause an electrical short therebetween and conduct electrical power from the battery to the laser light source.

12. A signaling buoy comprising:

a watertight enclosure comprising a compartment having lower and upper ends, a first cap closing the lower end of the compartment, and a second cap closing the upper end of the compartment;

an aperture in the second cap adapted for emitting a laser light beam therethrough;

a laser light source disposed within the second cap and adapted to generate the laser light beam;

a battery within the compartment for powering the laser light source;

at least two electrical contacts disposed on an exterior of the enclosure and adapted to complete an electrical circuit when an electrical short exists therebetween to conduct electrical power from the battery to the laser light source; and ballast associated with the first cap, the ballast being sufficient to cause the buoy to float upright in water with the first cap and the electrical contacts submersed in the water and the second cap disposed above the water.

13. The signaling buoy according to claim 12, further comprising a mechanical generator adapted to supplement and/or recharge the battery by generating electrical power in response to the signaling buoy being subjected to movement.

14. A method of using the signaling buoy of claim 12 to produce a distress signal, the method comprising placing the signaling buoy in water so that the ballast associated with the first cap of the enclosure causes the signaling buoy to right itself and submerse at least two of the electrical contacts in the water to cause an electrical short therebetween and conduct electrical power from the battery to the laser light source.

15. A method of producing a distress signal with a signaling buoy having lower and upper ends, the method comprising:

placing the signaling buoy in water so that the buoy is free floating in the water and the lower end of the signaling buoy is submersed in the water and the water creates an electrical short between at least two electrical contacts disposed on an exterior of the lower end of the buoy to cause electrical power to be conducted to a laser light source within the signaling buoy; and generating a laser light beam with the laser light source, the laser light beam being emitted vertically through an aperture in the upper end of the signaling buoy that is not submersed in the water.

16. The method according to claim 15, wherein the signaling buoy comprises a ballast associated with the lower end, the ballast being sufficient to cause the buoy to float upright in water with the electrical contacts and lower end submersed in the water.

17. The method according to claim 16, wherein the ballast locates a center of gravity of the buoy below the electrical contacts.

18. The method according to claim 15, wherein the laser light source emits a continuous wave beam.

19. The method according to claim 15, wherein the laser light source emits pulsed beams.

20. The method according to claim 15, further comprising generating electrical power to supplement and/or recharge a battery when the signaling buoy is subjected to movement.

* * * * *